US007695685B2

(12) United States Patent
Koide et al.

(10) Patent No.: US 7,695,685 B2
(45) Date of Patent: Apr. 13, 2010

(54) MICRO FLUIDIC DEVICE

(75) Inventors: Akira Koide, Inashiki (JP); Yoshishige Endo, Tsuchiura (JP); Yuzuru Ito, Tsuchiura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 865 days.

(21) Appl. No.: 11/439,821

(22) Filed: May 15, 2006

(65) Prior Publication Data

US 2006/0275180 A1 Dec. 7, 2006

(30) Foreign Application Priority Data

May 17, 2005 (JP) ..... 2005-143391

(51) Int. Cl.
*B01L 3/00* (2006.01)
*B01L 3/02* (2006.01)
*B01L 9/00* (2006.01)

(52) U.S. Cl. ..... 422/100; 422/99; 422/102; 422/104

(58) Field of Classification Search ..... 422/99, 422/100, 102, 104; 366/336, 341
See application file for complete search history.

(56) References Cited

U.S. PATENT DOCUMENTS 5,887,977 A 3/1999 Morikawa
2002/0140940 A1 10/2002 Bambot et al.
2004/0027915 A1* 2/2004 Lowe et al. ..... 366/341
2004/0100861 A1* 5/2004 Vanden Bussche et al. ..... 366/165.1
2004/0125689 A1 7/2004 Ehrfeld et al.
2004/0213083 A1 10/2004 Fujiwara et al.

FOREIGN PATENT DOCUMENTS

JP 2000-273188 10/2000

OTHER PUBLICATIONS

International Search Report dated Jan. 21, 2008 for European patent application EP06009652.

* cited by examiner

*Primary Examiner*—Jill Warden
*Assistant Examiner*—Dean Kwak
(74) *Attorney, Agent, or Firm*—Townsend and Townsend and Crew LLP

(57) ABSTRACT

A dent is formed on a side surface of a first substrate. A second substrate faces to the side surface of the first substrate. A third substrate is arranged so that the first and second substrates contact each other closely. A micro flow path and a micro chamber are formed between the first and second substrates. The micro flow path and the micro chamber communicate with each other and including an inlet and outlet respectively. A fifth substrate contains the first, second and third substrates. A fourth substrate fits in the fifth substrate. The first and second substrates are pressed against each other by thread fastening (pressing means) for the fourth and fifth substrates.

12 Claims, 4 Drawing Sheets

MICRO FLUIDIC DEVICE

BACKGROUND OF THE INVENTION

The present invention relates to a micro fluidic device for handling an extremely small volume of fluid, particularly relates to a micro fluidic device suitable for stirring, synthesizing, extracting and condensing the fluid.

A conventional micro fluidic device is disclosed by JP-A-2000-273188. In the device for forming an emulsion as described in this publication, for producing microspheres of constant diameter of tens of micrometers effectively and continuously, a high melting point fat or oil is heated to a temperature not less than the melting point to be liquefied, and the liquid of dispersed phase is pressurized and dispersed into a continuous phase through a plurality of micro-channels to form the emulsion. Subsequently, the continuous phase is removed from the emulsion to collect the microspheres of the high melting point fat or oil.

In the micro device disclosed by this publication, a substrate is arranged between a plate and a cover. Further, a surface of the substrate facing to the plate has a flat terrace including protrusions arranged at constant interval to form the micro channels between the protrusions. The micro channel is formed by wet or dry etching to have, for example, a width of 13.1 μm and a height of 5.7 μm.

BRIEF SUMMARY OF THE INVENTION

A volume for treatment in the conventional micro fluidic device for analysis is few micro liters, and an amount treated by the volume for treatment is tens of micro-liters per minute. Therefore, the micro fluidic devices of great number need to be operated in parallel to act as an actual plant.

In the micro volume of the micro fluidic device, an interface area ratio as a ratio of a contact surface area between the fluid and the micro fluidic device to a volume of the fluid is great so that a stability of a flow of the fluid depends on a condition of the contact surface area. If an accuracy for machining a tube of diameter of 10 mm is ±0.1 mm, an effect on an area of cross section by the machining accuracy is ±2%, but if the accuracy for machining the tube of diameter of 0.1 mm is ±0.01 mm, a deviation of the area of cross section is ±20%. As described above, the accuracy for machining corresponds exactly to a deviation of a flow rate. In JP-A-2000-273188, a decrease in deviation between flow passages is not considered sufficiently.

With taking the problem of the above mentioned prior art into consideration, an object of the invention is to decrease a difference in treatment between the devices. Another object of the invention is to increase a treating capacity of the micro fluidic device.

For achieving the object, in a micro fluidic device for treating a fluid in a micro flow path, comprising, a first substrate including a side surface having a dent, a second substrate arranged to face to the side surface of the first substrate, and a third substrate arranged to face to another side surface of the first substrate opposite to the side surface so that the first and second substrate contact each other, characterized in that a pressing element presses the first and second substrates against each other so that a micro flow path and a micro chamber are formed between the dent of the first substrate and the second substrate, and the micro flow path and the micro chamber communicate fluidly with each other and include at least one inlet and at least one outlet respectively.

It is preferable that the micro fluidic device further comprises a fourth substrate and a fifth substrate in which the fourth substrate fits and which contains the first, second and third substrate, the pressing element fastens the fourth and fifth substrate with respect to each other, and/or the third substrate is made of at least one of rubber and resin capable of absorbing a variation in thickness of the first substrate and a curvature in surface of the first and second substrate with an elastic deformation of the third substrate.

It is preferable that the third substrate is prevented from pressing at least a part of at least one of the micro flow path and chamber formed between the first and second substrate, and/or the third substrate is made of a metallic material capable of absorbing a variation in thickness of the first substrate and a curvature in surface of the first and second substrate with a plastic deformation of the third substrate. It is preferable that the second and fourth substrate are monolithic with respect to each other, and/or the first, second, third and fifth substrates have positioning areas for positioning the first, second and third substrate with respect to the fifth substrate.

It is preferable that the positioning areas are of truncated circular shape in which at least a part of the circular shape is removed along a straight line, the positioning areas include holes, one of the micro flow path and the micro chamber includes at least two of the inlets, the other one of the micro flow path and the micro chamber includes the outlet, the fourth substrate includes flow passages fluidly communicating with the inlets and outlet respectively, and/or the first, second, third, fourth and fifth substrate are stacked in order of the fifth, third, first, second and fourth substrate.

It is preferable that the dent on the first substrate has a first circular dent area, a second circular dent area and the micro flow path extending radially from the first circular dent area, the micro flow path is divided to two intermediate micro flow paths to converge subsequently so that the second circular dent area is arranged between the two intermediate micro flow paths and a partition wall is formed between the second circular dent area and the two intermediate micro flow paths, and the partition wall includes a nozzle for fluidal communication between the second circular dent area and the two intermediate micro flow paths, and/or the fifth substrate includes flow passages for supplying a first fluid to the first circular dent area and supplying a second fluid to the second circular dent area so that an emulsion is formed from the first and second fluid at the second circular dent area.

It is preferable that at least one of the side surface of the first substrate and a side surface of the second substrate facing to the side surface of the first substrate is formed by a thin film of at least one of metal and resin, and/or at least one of the side surface of the first substrate and a side surface of the second substrate facing to the side surface of the first substrate forms at least one of the micro flow path and the micro chamber and is coated with glass.

According to the invention, since micro spaces acting as the micro fluidic devices are formed on a single substrate by machining and/or surface treatment, a variation caused by the machining and/or surface treatment is decreased. Further, since flow resistances against liquid flow to the micro spaces operating in parallel are uniformized, an even stirring, synthesizing, condensing or the like is obtainable.

Other objects, features and advantages of the invention will become apparent from the following description of the embodiments of the invention taken in conjunction with the accompanying drawings.

BRIEF DESCRIPTION OF THE SEVERAL VIEWS OF THE DRAWINGS

FIG. 2*a* is a longitudinally cross sectional view of parallel treating areas of the micro fluidic device shown in FIG. 1.

DETAILED DESCRIPTION OF THE INVENTION

Figure 1:
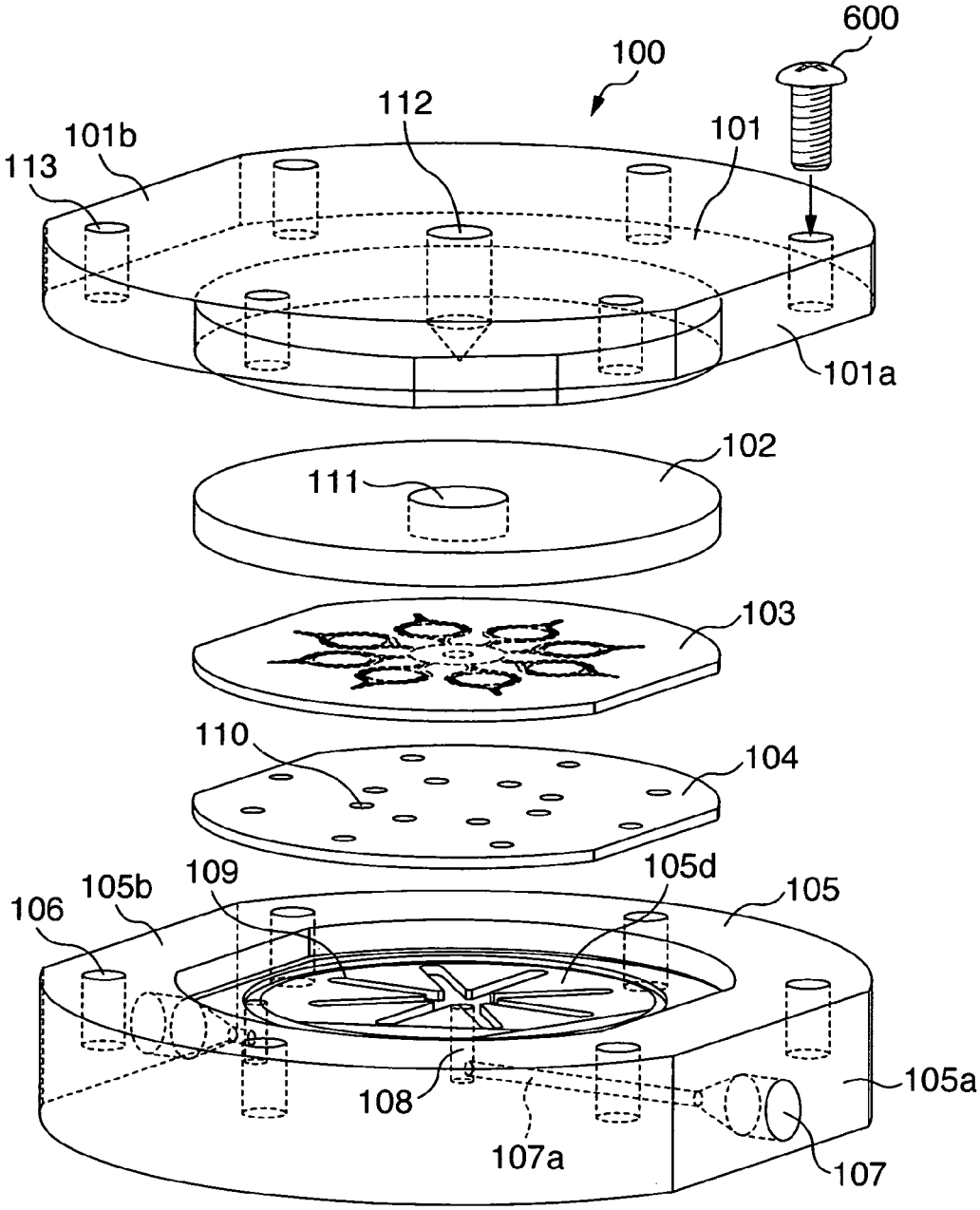
FIG. 1 is an oblique projection exploded view of an embodiment of a micro fluidic device of the invention.
Figure 2A:
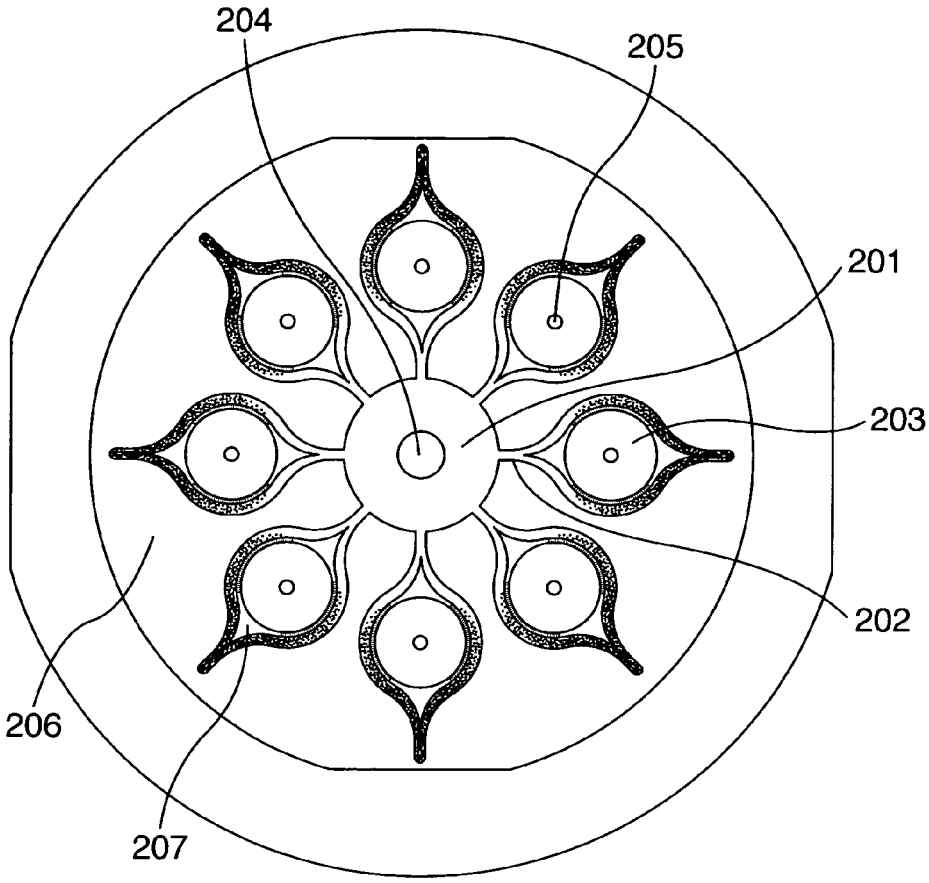
FIG. 2*a* is an upper view of parallel treating areas of the micro fluidic device shown in FIG. 1.
Figure 2B:
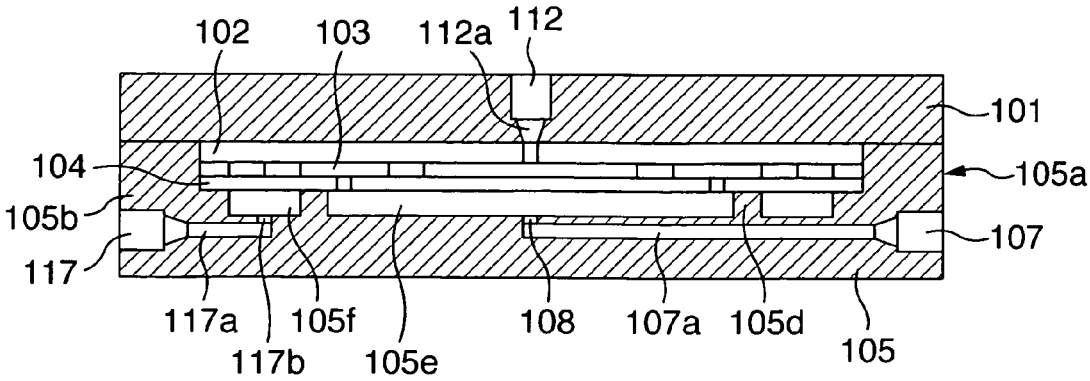

Hereafter, an embodiment of micro fluidic device of the invention will be described with making reference to the drawings. FIG. 1 is an oblique projection exploded view of a micro fluidic device 100, and FIG. 2 includes an upper view (FIG. 2*a*) and a longitudinally cross sectional view (FIG. 2*b*) of a parallel treating areas of the micro fluidic device 100. Incidentally, FIG. 2*b* does not include section line for three substrates 102-104 between two substrates 101 and 105. In the micro fluidic device 100 as the embodiment, two kinds of liquid are joined to form single liquid to be discharged.

The micro fluidic device 100 includes sheet-shaped first, second and third substrates 102-104 between a fifth substrate 105 arranged at a lower side and including a recess at a central area and a fourth 101 substrate fitted in the recess of the fifth substrate 105. The fourth substrate 101 has a plurality of through holes 113 for receiving screws and the fifth substrate 105 has a plurality of thread holes 106 at respective outer peripheral positions corresponding to the through holes 113 so that the recess of the fifth substrate 105 is hermetically sealed. Side surfaces of the fourth and fifth substrates 101 and 105 form parallel planar surfaces 101*a* and 101*b* and parallel planar surfaces 105*a* and 105*b*.

The fourth substrate 101 as upper most substrate has a through hole 112*a* at a central position thereof, and a joint 112 for introducing a first liquid is formed or mounted on the hole 112*a*. At a lower side of the recess of the fifth substrate 105 as the lowermost substrate, a micro flow path as described below is formed, and an introduction path 107*a* for introducing a second liquid into the micro flow path extends radially from the side planar surface 105*a* to a central area. A joint is formed or mounted on an end of the introduction path 107*a* at the planar surface 105*a*. On the central area of the fifth substrate 105, a second liquid supply flow path 108 connected to the introduction path 107*a* extends vertically from an upper surface.

The recess of the fifth substrate 105 includes two stages, and an upper stage for receiving the first, second third substrates 102-104 form a hole slightly greater than outer peripheries of the substrates 102-104. A ring-shaped recess 105*f* as lower stage is formed below the upper stage. An outer diameter of the ring-shaped recess 105*f* as lower stage is smaller than the outer peripheries of the substrates 102-104. A discharge hole 117*a* extends radially inward from the side surface 105*b* of the fifth substrate 105 to a position of the recess 105*f* as lower stage, and a joint 117 is formed or mounted on an end of the hole 117*a* at the planar surface 105*b*. A hole 117*b* extends vertically from a bottom surface of the recess 105*f* as lower stage to the discharge hole 117*a*. Eight even distribution flow paths 109 communicating with the liquid supply flow path 108 extend radially with constant circumferential interval, as shown in FIG. 1.

The first, second third substrates 102-104 between the fourth and fifth substrates 101 and 105 will be described hereafter in detail. The uppermost third substrate 102 is a disk including a hole 111 for supplying the first liquid at a central area, and faces to a bottom side of the fourth substrate 101. Incidentally, the outer peripheral shape of the third substrate is circular, but may be of truncated circular shape as the below described first and second substrates 102 and 103.

The first substrate 103 is arranged under the third substrate 102. The first substrate 103 is of truncated circular shape in which two portions are removed from a thin disk along parallel lines. This enables it to be positioned circumferentially with respect to the even distribution flow paths 109 on the fourth substrate. The embodiment has a truncated circular shape in which opposite portions are removed from the disk shape, but may have one notch or positioning hole, or the substrate 103 may be polygonal.

The second substrate 104 including holes 110 formed on respective positions corresponding to the even distribution flow paths 109 on the fourth substrate to supply the second liquid to grooves as the micro flow paths on the first substrate 103 is arranged under the first substrate 103. The second substrate 104 is of the substantially same truncated circular shape as the first substrate 103.

In the embodiment, for increasing an amount treated by the micro fluidic device 100, a flow path for laminar flow in which layers of not less than thousands flow parallel is formed. Therefore, the two kinds of liquids are joined uniformly at the first substrate. A lower surface of the first substrate 103 is treated by a method usable for semiconductor lithography to form the micro chamber and the micro flow path. Concretely, a first micro chamber 201 of substantially circular shape is formed between the first substrate 103 and the second substrate 104 at the central area. The first liquid is introduced into the first micro chamber 201 by a central hole 204 on the first substrate 103. Eight micro flow paths 202 extending radially outward from the first micro chamber 201 communicates with the first micro chamber 201 so that the first liquid is distributed from the first micro chamber 201 evenly to the eight micro flow paths 202 to be discharged radially outward. This flow is of continuous phase.

Subsequently, the flow of continuous phase is mixed with another material liquid of dispersal phase to be uniformized. Concretely, the radially extending eight micro flow paths 202 are divided at respective radial positions of the substantially same radius to two diverging flow paths for the continuous phase, and subsequently the diverging flow paths converge. At the divided positions, the second circular micro chambers 203 are formed. The second micro chambers 203 are separated from the diverging flow paths by thin walls. The second liquid is introduced into the second micro chambers 203 from the through holes 110 on the second substrate 104, and the first liquid is introduced by the nozzles formed on the thin walls so that the liquids are mixed with each other at the second micro chambers 203.

Figure 3:
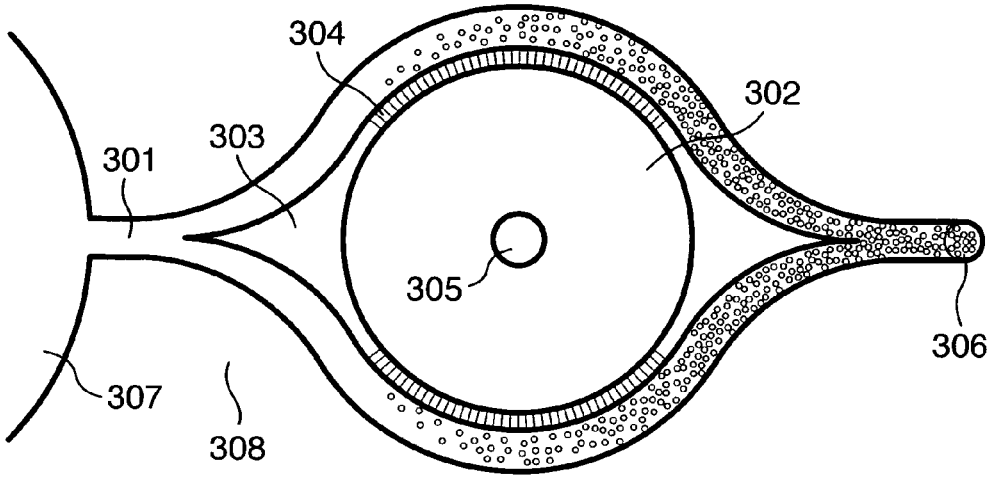
FIG. 3 is an enlarged partial upper view of the parallel treating areas shown in FIGS. 2*a* and 2*b*.

This mixture is explained with making reference to FIG. 3. The first liquid supplied from a first micro chamber 307 corresponding to the first micro chamber 201 shown in FIG. 2 flows radially outward through the eight micro flow paths 301. The micro flow path 301 is divided to two diverging flow paths between which the second micro chamber 302 for mixing the first and second liquids with each other is arranged. The micro flow path 301 and the second micro chamber 302 are separated from each other by a partition wall 303. The second liquid supplied to the second micro chamber 302 through a through hole 305 is discharged into the micro flow path 301 through numerous micro nozzles 304 on the partition wall 303 so that the first and second liquids are mixed with each other.

Since the eight second micro chambers 302 are arranged at respective positions of the same radial distance and have the substantially same shape, the first liquid flows evenly among the eight flow paths. Since the second liquid flows radially outward from the eight circular second micro chambers 302, lengths of the flows are uniformized. Therefore, the first liquid is discharged substantially evenly from the numerous micro nozzles 304 on the partition wall 303.

The wall 303 separating the micro flow path 301 and the second micro chambers 302 from each other needs to have sufficient sealing performance. Therefore, for securely obtaining the sealing performance, they are made contact closely each other by being pressed evenly by the second substrate. The event pressure is sufficient for generating a surface pressure sufficient for making the first substrate 103 and the second substrate 104 contact closely each other. If the first micro chamber 307 and second micro chamber 302 have a height of about hundreds μm, a diameter of several millimeters on a diaphragm structure of a thickness of 1 mm, a deformation of the diaphragm is not negligible with respect to the height of about hundreds μm of the micro chamber.

Figure 5:
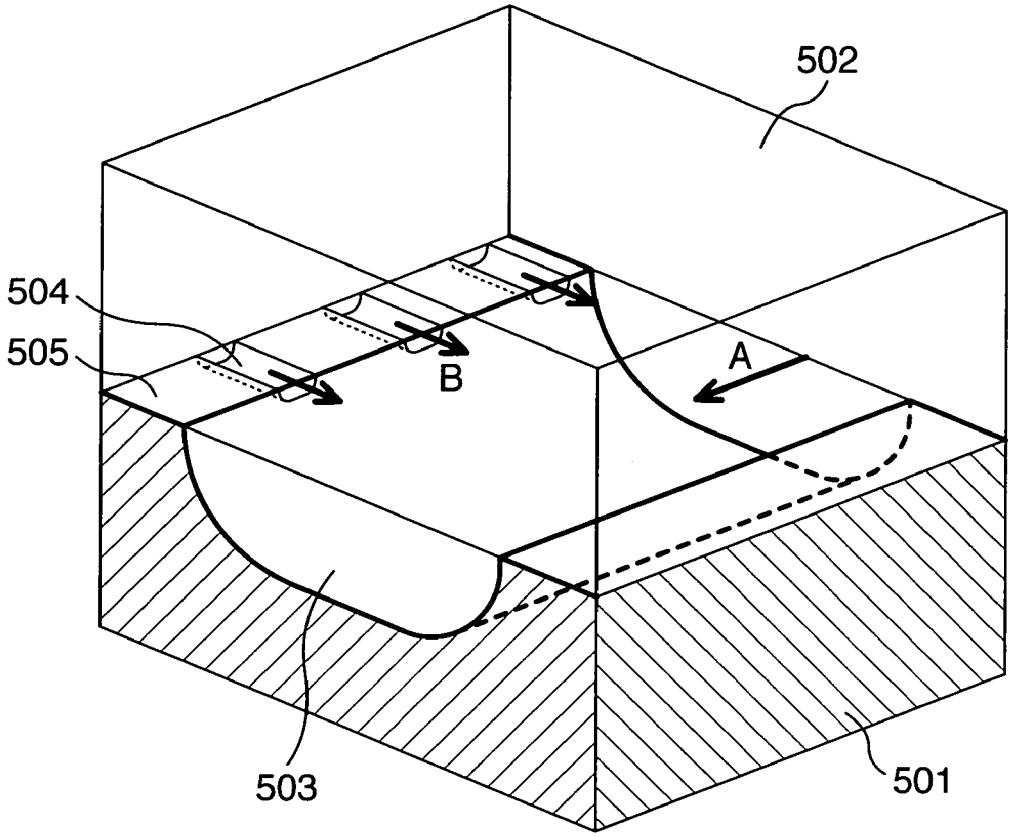
FIG. 5 is a view for explanation on mixing between first and second liquids.

This condition is explained with making reference to FIG. 5. The second liquid is discharged from the nozzles 504 evenly into the first liquid in a micro flow path 503 formed by making the first substrate 501 and the second substrate 502 contact closely each other. For forming parallel flow of thousands layers in the first substrate 501 of about ϕ40 mm, the micro nozzles 504 of a width of several μm to tens μm need to be mounted in high density. Therefore, a width of a sealing surface between the micro nozzles 504 is made from tens μm to hundreds μm. Since a deterioration of the sealing performance on the sealing surface causes a failure of forming the parallel flow of thousands layers, the first substrate 501 and the second substrate 502 are made contact each other closely over the whole surfaces thereof to obtain securely the sealing performance.

In the embodiment, in the part of diaphragm structure, the third substrate 102 is arranged to be prevented from contacting the first substrate 103 so that the uniform pressing force is prevented from being applied to the deformable area. That is, the through hole 111 is formed only on the central area of the third substrate 102 contacting the area of the first micro chamber 201. The pressing on the area of the first micro chamber 201 is prevented. As a matter of course, it is preferable that non-pressing area is formed on the area of the first substrate 103 contacting the area of the second micro chamber 203. Incidentally, the third substrate 102 is made of a material having rubber elasticity or metal such as copper, aluminum or the like plastically deformable. Further, the pressing force is obtained by inserting the screw into the through holes 113 on the fourth substrate 101 to be screwed in the thread hole 106 formed on the fifth substrate 105.

The third substrate 102 is used to absorb an unevenness in thickness and a curvature of the first substrate 103 and second substrate 104 to be made contact closely each other. Therefore, since it is made of a sheet of great deforming capacity, it is slightly smaller than the first substrate 103 and second substrate 104. It can expand in a planar direction when being compressed. A best material for the third substrate 102 is a resin sheet having the rubber elasticity and high chemical resistance. Incidentally, when being used as disposable element, a plastic deformability of metal is usable.

When the first substrate 103 and second substrate 104 have a portion whose dimension in thickness is smaller by single digit than a planar dimension of the micro chamber formed on the first substrate 103 and second substrate 104, the portion is prevented from being pressed so that a volume of the micro chamber is prevented from being decreased by even pressing over the third substrate 102. Further, the surfaces of the first substrate 103 and second substrate 104 to be made contact each other closely need to have a surface roughness for obtaining the sufficient sealing performance. Therefore, when the substrate material is stainless steel, the roughness is about 0.8 μm as Rmax in a width of about tens μm, although it varies in accordance with a width of the sealing surface separating the micro chambers from each other and the material of substrate.

Figure 4:
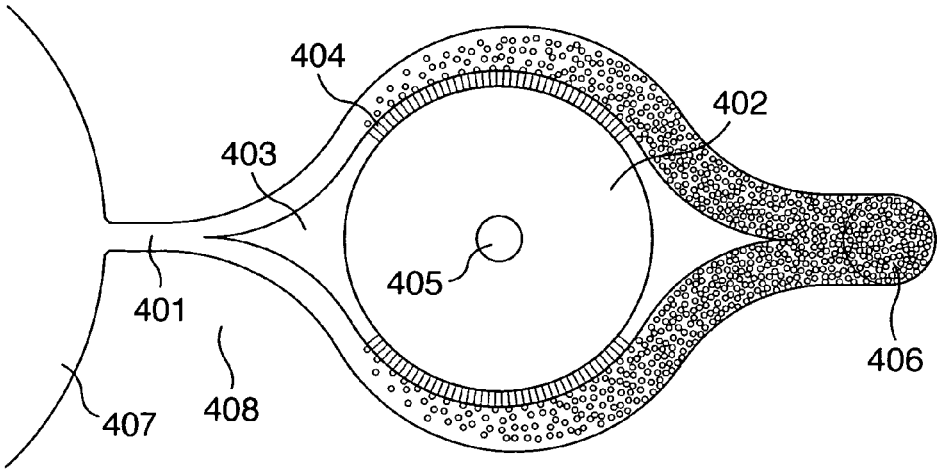
FIG. 4 is an enlarged partial upper view of the parallel treating areas shown in FIGS. 2*a* and 2*b*.

A case in which an emulsion is produced from two kinds of liquid non-mixable with each other by the micro fluidic device 100 formed as described above, is explained with making reference to FIG. 4 as an enlarged view of the parallel treating portions. In this embodiment, a width of the divided micro flow path increases along a flow proceeding direction. That is, a number of the micro nozzles 404 for injecting the second liquid increases along a flow proceeding direction in the micro flow path 401 so that a flow rate is increased by an amount of the liquid discharged from the numerous micro nozzles 404. A flow velocity increases along the flow proceeding direction in accordance with the increase of the amount of the liquid when the width of the micro flow path 401 is constant, but since the width of the micro flow path increases along the flow proceeding direction, a variation of the flow velocity is decreased so that a uniformity in diameter of the emulsion is improved.

A material of each of the substrates 101-105 of the micro fluidic device 100 is a metal of high thermal conductivity when a temperature control is needed. But, a metallic corrosion is caused in accordance with kinds of the liquids as the first and second liquid. Therefore, surfaces of the substrates 101-105 is coated with a chemical resistance thin film through film forming process such as spattering, vapor deposition, CVD or the like. When the substrates 101-105 are made of glass or resin, the thin coating film is formed by applying a solution including a coating agent onto the substrates and subsequently volatilizing an unrequired substance by thermal treatment.

When the metallic surface is coated with glass, a solution of super-saturated glass is applied onto the metallic film, and subsequently the glass is precipitated. Incidentally, forming the thin film brings about a further merit such as improvement of sealing performance, if being made of a material of plastically deformable, such as the metallic thin film or resin thin film. But, since in a case of a brittle material such as glass or ceramic, a probability of localized contact concentration exists, it is preferable for a flattening treatment to be performed after the coating.

In the above embodiment, the micro fluidic device is made of stainless steel or glass substrate. When the micro fluidic device is made of such material, the flow path on the metallic surface is formed by melting a metal to be removed from a part corresponding to the flow path through wet-etching or removing a die from the surface plated to form a thick film thereon after the die covers the part corresponding to the flow path.

When the wet etching is used, for forming the micro fluidic path more accurately, the flow path needs to be designed with taking a flow of etching liquid caused by a difference in temperature or concentration in the etching into consideration. In this case, since the etching progresses under diffusion rate control, an opening area of an etching mask is designed to make an etching rate at a required width or depth of the flow path as small as possible or nearly zero.

When the plating forming the thick film is used, a thick film resist is formed by film resist. Alternatively, it is formed by forming with a semiconductor micro-fabrication technique such as Deep-RIE, a shape of material such as monocrystal silicon or glass different from a metal in soluble characteristic. The micro flow path can be formed by plating over the formed thick film with utilizing a high dimensional accuracy of semiconductor. Further, since the surface of the substrate formed by the plating does not have a flatness sufficient for obtaining the secure sealing performance, it is finished by grinding to become finally a mirror surface.

When the area for contacting the first and second liquid is made of glass, the flow path is formed on the glass substrate or the substrate surface of another material on which the flow path is formed is coated with glass. When the monocrystal silicon is used as substrate material, the micro flow path is formed accurately on the monocrystal silicon substrate through the processing technique for semiconductor. Thereafter, the substrate is thermally treated to be oxidized so that uniform glass is formed on the substrate.

When the flow path is directly formed on the glass substrate, with taking processing accuracy into consideration, it is dissolved by fluorochemical etching liquid in dry etching or dry etching for semiconductor. The wet etching on the glass substrate is similar to the wet etching for metal, and its accuracy is improved similarly. Further, if the accuracy for forming the flow path may be low, the flow path may be formed by removing treatment using sand blasting. in this case, a diameter of sand for sand blasting is made small to decrease a size of chipping. If the micro flow path is formed by shape decal transferring with hot embossing treatment, a cost for mass production can be decreased. When the substrate is made of the resin, the shape decal transferring is performed by the substrate having rubber elasticity such as polydimethilsiloxane and the thick film resist. For the resin substrate such as polystyrene or polycarbonate, the injection forming or hot embossing treatment is used.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A micro fluidic device for treating a fluid in a micro flow path, comprising, a first substrate including a side surface having a dent, a second substrate arranged to face to the side surface of the first substrate, a third substrate arranged to face to another side surface of the first substrate opposite to the side surface so that the first and second substrate contact each other, and a pressing element for pressing the first and second substrates against each other so that a micro flow path, a first micro chamber and a second micro chamber are formed between the dent of the first substrate and the second substrate; and a fourth substrate and a fifth substrate in which the fourth substrate fits and which contains the first, second and third substrate, wherein the pressing element fastens the fourth and fifth substrate with respect to each other, wherein each of the first and second micro chambers includes an inlet, and the micro flow path includes an outlet, wherein the micro flow path extends radially from the first micro chamber, the micro flow path is divided to two intermediate micro flow paths to converge subsequently so that the second micro chamber is arranged between the two intermediate micro flow paths and a partition wall is formed between the second micro chamber and the two intermediate micro flow paths, and the partition wall includes a nozzle for fluidal communication between the second micro chamber and the two intermediate micro flow paths.

2. The micro fluidic device according to claim 1, wherein the third substrate is made of at least one of rubber and resin capable of absorbing a variation in thickness of the first substrate and a curvature in surface of the first and second substrates with an elastic deformation of the third substrate.

3. The micro fluidic device according to claim 1, wherein the third substrate is prevented from pressing at least a part of at least one of the micro flow path and first and second chambers formed between the first and second substrate.

4. The micro fluidic device according to claim 1, wherein the third substrate is made of a metallic material capable of absorbing a variation in thickness of the first substrate and a curvature in surface of the first and second substrate with a plastic deformation of the third substrate.

5. The micro fluidic device according to claim 1, wherein the third and fourth substrates are not separable from each other.

6. The micro fluidic device according to claim 1, wherein the first, second, fourth and fifth substrates have positioning areas for positioning the first, second and fourth substrates with respect to the fifth substrate.

7. The micro fluidic device according to claim 6, wherein the positioning areas are of truncated circular shape in which at least a part of the circular shape is removed along a straight line.

8. The micro fluidic device according to claim 6, wherein the positioning areas include holes.

9. The micro fluidic device according to claim 1, wherein the fifth substrate includes flow passages fluidly communicating with one of the inlets and the outlet respectively, and the first, second, third, fourth and fifth substrate are stacked in order of the fifth, second, first, third, and fourth substrate.

10. The micro fluidic device according to claim 1, wherein the fourth substrate includes a flow passage for supplying a first fluid to the first micro chamber and the fifth substrate includes another passage for supplying a second fluid to the second micro chamber so that an emulsion is formed from the first and second fluid at the second micro chamber.

11. The micro fluidic device according to claim 1, wherein at least one of the side surface of the first substrate and a side surface of the second substrate facing to the side surface of the first substrate is formed by a thin film of at least one of metal and resin.

12. The micro fluidic device according to claim 1, wherein at least one of the side surface of the first substrate and a side surface of the second substrate facing to the side surface of the first substrate forms at least one of the micro flow path and the first and second micro chambers and is coated with glass.

* * * * *